US006447377B1

(12) United States Patent
Londenberg et al.

(10) Patent No.: US 6,447,377 B1
(45) Date of Patent: Sep. 10, 2002

(54) DRY ICE BLASTING GUN WITH ADJUSTABLE HANDLE

(75) Inventors: Joel Londenberg, Yucaipa, CA (US); Alan E. Opel, Monrovia, CA (US)

(73) Assignee: CAE Alpheus, Inc., Rancho Cucamonga, CA (US)

( * ) Notice: Subject to any disclaimer, the term of this patent is extended or adjusted under 35 U.S.C. 154(b) by 0 days.

(21) Appl. No.: 09/975,904

(22) Filed: Oct. 12, 2001

(51) Int. Cl.[7] ..... B24C 3/00

(52) U.S. Cl. ..... 451/90; 451/102; 134/172; 239/227

(58) Field of Search ..... 451/90, 102, 75; 239/227; 134/17, 129, 131, 144, 148, 151, 167 R, 172, 198

(56) References Cited

U.S. PATENT DOCUMENTS

| | | | | | |
|---|---|---|---|---|---|
| 3,827,635 | A | * | 8/1974 | Krakowski et al. | 239/391 |
| 3,874,594 | A | * | 4/1975 | Hatley | 239/227 |
| 4,541,971 | A | * | 9/1985 | Takashima | 264/30 |
| 5,188,293 | A | * | 2/1993 | Burton | 239/227 |
| 6,021,793 | A | * | 2/2000 | Moulder | 134/167 R |
| 6,390,816 | B2 | * | 5/2002 | Ito et al. | 433/88 |

* cited by examiner

*Primary Examiner*—Eileen P. Morgan
(74) *Attorney, Agent, or Firm*—Donald D. Mon

(57) ABSTRACT

A hand-held blasting gun for use in dry ice blasting for cleaning purposes. A handle and a nozzle mount are pivotally joined so a nozzle on the nozzle mount can be adjustably directed relative to the handle. A flexible hose is fitted in the gun, extending from the end of the handle to the nozzle so as to send without kinking.

8 Claims, 2 Drawing Sheets

DRY ICE BLASTING GUN WITH ADJUSTABLE HANDLE

FIELD OF THE INVENTION

A hand held blasting gun for controlling and directing toward a surface to be cleaned a blasting stream of pressurized air laden with dry ice particles.

BACKGROUND OF THE INVENTION

Pressurized streams laden with particles of dry ice are directed against a surface to be cleaned, similar to the commonly known sand blasting. A significant advantage of using dry ice particles instead of sand is that the solid carbon dioxide will sublime, leaving no residue of its own to be cleaned up.

Because the dry ice is very cold, care must be taken to protect its user so that the nozzle can be conveniently and safely held and manipulated. A clear line of vision, minimum weight of gun and hose, ability to transfer the gun from one hand to the other without stepping over the hose, and convenient adjustment of the nozzles direction relative to a handle. All can contribute to safety, efficiency and convenience.

In commonly-known dry ice blasting guns, there is a tendency for the particles to agglomerate and plug up the gun, at times even when care is taken to avoid it. It is an object of this invention to provide a gun which enables the direction of the nozzle to be adjusted through a wide angular range while maintaining a smooth passageway, resulting in minimal or nearly non-existent likelihood of clogging.

Another advantage offered by the present invention is illumination directly ahead of the nozzle, whatever its angle relative to the handle, so the operator can see into cavities or recessed areas he is cleaning, rather than have to stop from time to time to see what he has done.

In addition, this construction provides important ergonomic benefits, because the operator can adjust the nozzle to his most comfortable position while maintaining his hand, thereby also reducing stress.

BRIEF DESCRIPTION OF THE INVENTION

A dry ice blasting gun according to this invention includes a handle to be held by the operator, and a nozzle mount pivotally mounted to the handle. A nozzle is carried by the nozzle mount, and adjustment means holds the nozzle mount and therefore also the nozzle in a selected angular position relative to the handle. The handle carries a switch to control the flow of the blasting stream.

A flexible hose which retains sufficient flexibility under the reduced temperatures involved is mounted in both the handle and in the nozzle mount, between arc-limiting guides as the angle is changed between the handle and the nozzle mount.

According to a preferred but optional feature of the invention, a light is mounted in the nozzle mount, aligned with the nozzle and including the base of the nozzle, whereby the operator can have a better view of the work area.

According to yet another preferred but optional feature of the invention, a bayonet coupling in the nozzle mount allows for selected sizes of nozzle to be easily and quickly substituted for one another.

The above and other features of this invention will be fully understood from the following detailed description and the accompanying drawings, in which:

DETAILED DESCRIPTION OF THE INVENTION

Figure 1:
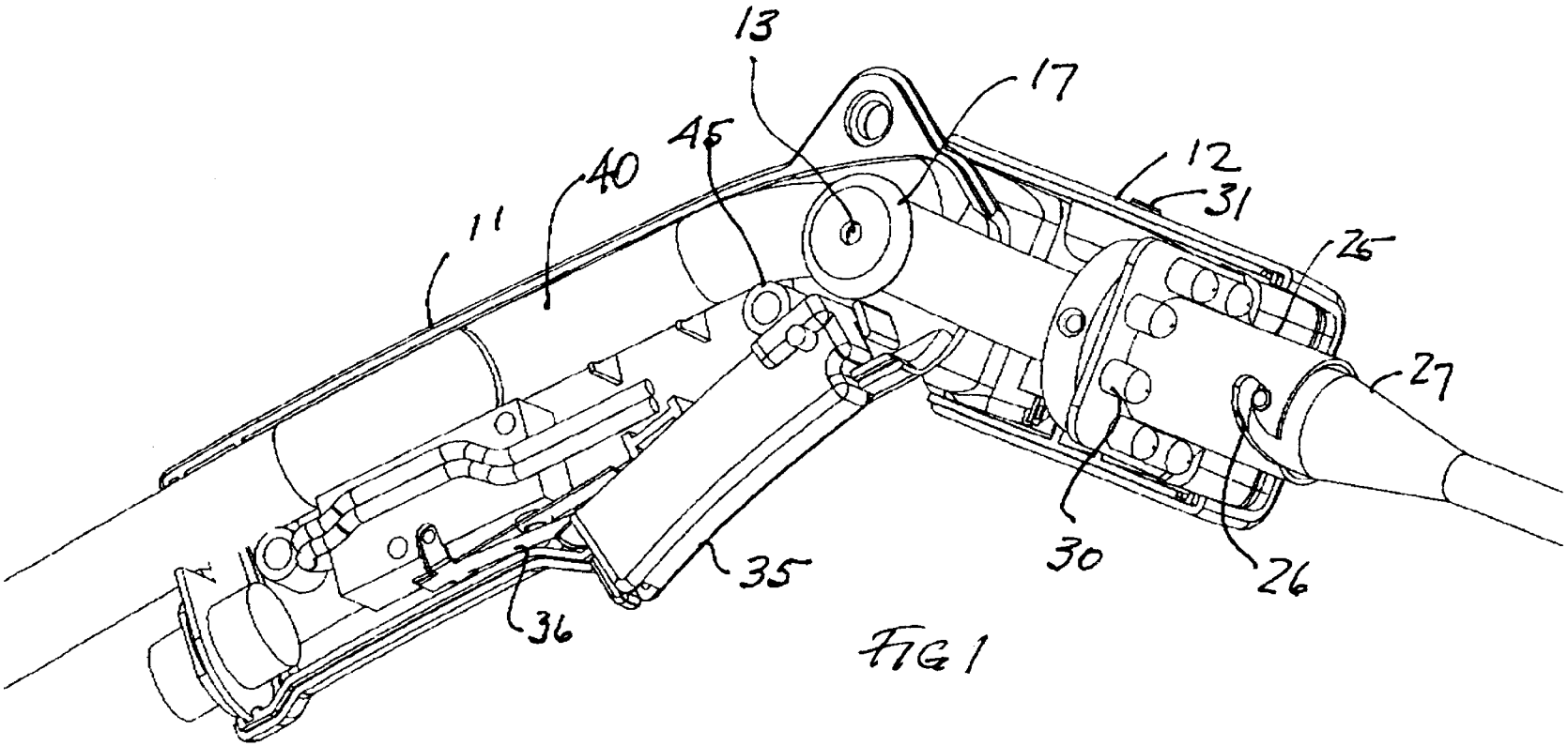
FIG. 1 is an axial section of the preferred embodiment of the invention.
Figure 5:
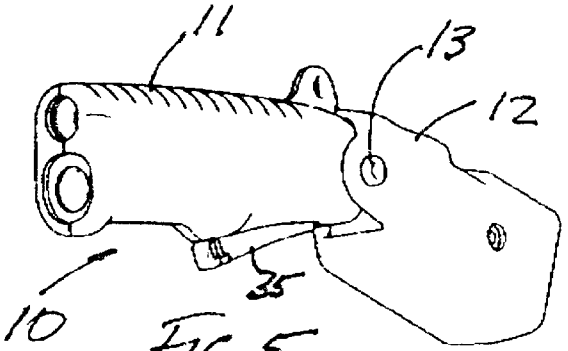
FIG. 5 is a fragmentary oblique view particularly showing the pivot arrangement.
Figure 4:
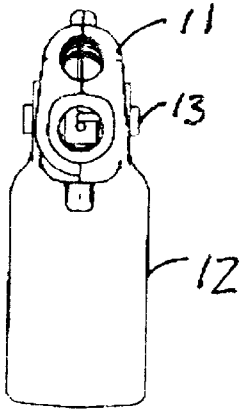
FIG. 4 is an end view of the handle.

The presently preferred embodiment of a dry ice blasting gun 10 according to this invention is shown in FIG. 1. It includes a handle 11 and a nozzle mount 12. These are held together by a pivot 13. The nozzle mount can thereby be turned to any angular position relative to the handle within an allowable range.

The pivot is provided on both sides because it can not pass through the hose where it would obstruct ice flow. At each side there is a central port with a head in the handle, and a head 17 on its outer end overhanging a portion of the nozzle mount. A washer spring washer 18 is biased between head 17 and a portion of the nozzle mount to force them together. Meshing teeth (not shown) may provide engagement to resist rotation. These are camming teeth that can be overcome to pivot the nozzle mount.

Figure 2:
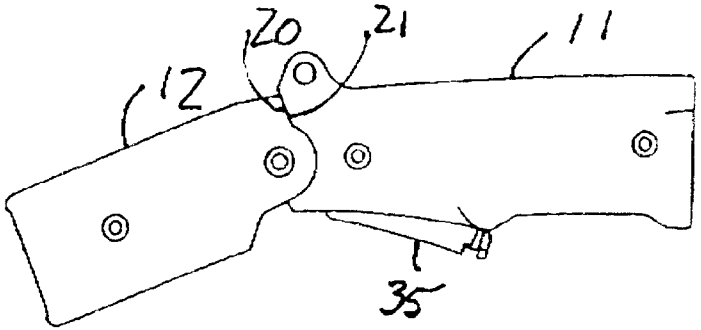
FIG. 2 is a side view of the blasting gun of FIG. 1 in one of its extreme adjustments.
Figure 3:
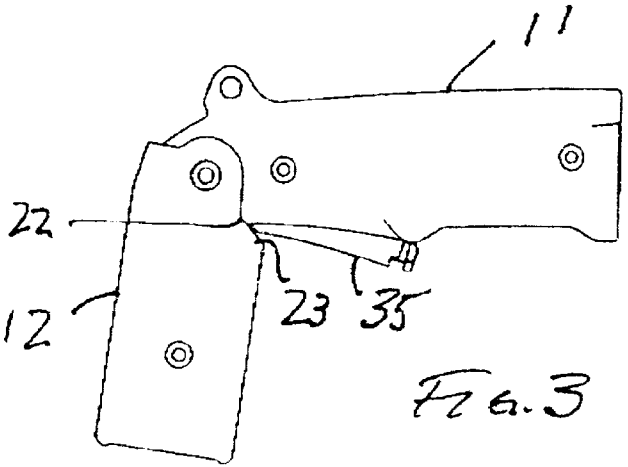
FIG. 3 is a side view similar to FIG. 2, but showing the blasting gun in its other extreme adjustments.

Stop surfaces 20, 21 (FIG. 2) and 22, 23 (FIG. 3 on the handle and on the nozzle mount will engage one another at the extreme limits of movement. FIG. 2 shows the engagement of surfaces 20 and 21 when the nozzle mount is more nearly aligned with the handle. In FIG. 3 surfaces 22 and 23 engage one another when the two parts more nearly resemble a pistol grip.

As best shown in FIG. 1 the nozzle mount includes a connector 25 with a bayonet coupler 26 on its exposed end. A nozzle 27 of a selected size, with a stud for engagement in the coupler can be attached to the nozzle mount. Any suitable nozzle may be used with this handle.

A light 30, preferably comprising a ring of LEDs or incandescent bulbs surrounds the coupler. They are directed in the direction of the nozzle to illuminate the work. A light switch 31 can be fixed to the nozzle mount or to the handle as preferred to turn the lights on or off or to adjust its brightness. Suitable circuitry (not shown) is provided for the lights and for the switch.

A trigger 35 is hingedly mounted to the handle, where it can be squeezed by the operator to actuate the gun. It can bear against a control switch 36 to actuate the device. It is spring-loaded to the "off" position.

A delivery hose 40 has an entry end 41 to be connected to a source of the blasting stream. It has a delivery end connected to connector 25 to supply the nozzle. Hose 40 is made of a material which retains sufficient flexibility to bend even at the low temperatures involved.

A suitable material is a fiber reinforced low temperature silicon hose such as nutrasil.

Arc-limiting guide 45 limits the bend of the hose so it will not kink or fold. This reduces risk of plugging or agglomeration.

Because the hose enters the gun from the rear or bottom of the handle, it can be moved from hand to hand with no interference with the hose, while maintaining the hand directly behind the resistive thrust vector for improved ergonomics The angle is readily adjustable in use, and nozzles of various sizes can easily be exchanged.

This invention is not to be limited by the embodiment shown in the drawings and described in the description, which is given by way of example and not of limitation, but only in accordance with the scope of the appended claims.

We claim:

1. A hand-held blasting gun for directing a blasting stream of dry ice particles and a carrier of gas, said blasting gun comprising:

a handle adapted to be held in an operator's hand, and having a first end and a second end;

an actuating switch on said handle engageable by the operator;

a nozzle mount;

a pivot pivotally joining the second end of said handle to said nozzle mount, whereby the angle between them can adjustably be varied;

a nozzle removably mounted to said nozzle mount;

a flexible hose passing through said handle and said nozzle mount having one end to be connected to a source of said blasting stream, and the other connected to said nozzle mount and by it to said nozzle;

said hose passing inside said handle at its said first end, and being protected from exposure by said handle and nozzle mount.

2. Apparatus according to claim 1 in which guide surfaces inside said gun at said pivot prevent the hose from kinking.

3. Apparatus according to claim 1 in which said nozzle mount includes a connector with a bayonet coupler to which a nozzle can be removably attached.

4. Apparatus according to claim 1 in which a light is provided in said nozzle mount facing in the direction of the nozzle, and encircling the nozzle mount.

5. Apparatus according to claim 1 in which said pivot includes means releasably to hold the adjustment of the handle and the nozzle mount.

6. Apparatus according to claim 2 in which said nozzle mount includes connection with a bayonet coupler to which a nozzle can be removably attached.

7. Apparatus according to claim 6 in which a light is provided in said nozzle mount facing in the direction of the nozzle, and encircling the nozzle mount.

8. Apparatus according to claim 7 in which said pivot includes means releasably to hold the adjustment of the handle and the nozzle mount.

* * * * *